US006379234B1

(12) United States Patent
MacKay

(10) Patent No.: US 6,379,234 B1
(45) Date of Patent: Apr. 30, 2002

(54) REUSABLE MOUNT FOR ABRASIVE DEVICES

(76) Inventor: Joseph H. MacKay, 16445 Roca Dr., San Diego, CA (US) 92128

( * ) Notice: Subject to any disclaimer, the term of this patent is extended or adjusted under 35 U.S.C. 154(b) by 0 days.

(21) Appl. No.: 09/592,203

(22) Filed: Jun. 13, 2000

Related U.S. Application Data

(60) Provisional application No. 60/138,998, filed on Jun. 14, 1999.

(51) Int. Cl.[7] ..... B24B 23/00

(52) U.S. Cl. ..... 451/359; 451/508; 451/510; 451/514; 451/515

(58) Field of Search ..... 451/359, 508, 451/510, 520, 521, 514, 515

(56) References Cited

U.S. PATENT DOCUMENTS

| | | | | | |
|---|---|---|---|---|---|
| 302,952 | A | * | 8/1884 | Smith | 451/510 |
| 320,892 | A | | 6/1885 | Strong | |
| 415,371 | A | | 11/1889 | Smith | |
| 489,149 | A | | 1/1893 | Hyde | |
| 506,350 | A | * | 10/1893 | Towne | 451/508 |
| 507,223 | A | | 10/1893 | Hyde | |
| 566,883 | A | | 9/1896 | Alden et al. | |
| 791,159 | A | | 5/1905 | Norton | |
| 791,791 | A | | 6/1905 | Hurford | |
| 872,932 | A | | 12/1907 | Hall | |
| 1,162,970 | A | | 12/1915 | Binford | |
| 1,724,742 | A | | 8/1929 | Albertson et al. | |
| 1,896,738 | A | * | 2/1933 | Adornetto | 451/510 |
| 1,998,919 | A | | 4/1935 | Ball et al. | |
| 2,278,301 | A | | 3/1942 | Bauer | |
| 2,567,782 | A | | 9/1951 | Rhees | |
| 2,671,994 | A | * | 3/1954 | Hickman | 451/508 |
| 3,041,797 | A | | 7/1962 | Moffly | |
| 3,081,584 | A | | 3/1963 | Bullard | |
| 3,136,100 | A | | 6/1964 | Robertson, Jr, | |
| 3,376,675 | A | * | 4/1968 | Hutchins | 451/508 |
| 3,500,592 | A | | 3/1970 | Harrist | |
| 3,596,415 | A | | 8/1971 | Donahue, Jr. | |
| 3,621,621 | A | | 11/1971 | Husack | |
| 3,800,483 | A | | 4/1974 | Sherman | |
| 3,879,178 | A | | 4/1975 | Bosma | |
| 3,912,411 | A | | 10/1975 | Moffat | |
| 3,960,516 | A | | 6/1976 | Biardi | |
| 4,026,074 | A | | 5/1977 | Dais et al. | |
| 4,054,425 | A | | 10/1977 | Sherman | |
| 4,088,729 | A | | 5/1978 | Sherman | |
| 4,240,230 | A | | 12/1980 | Ferrantini | |
| 4,322,920 | A | | 4/1982 | Wells | |
| 4,439,953 | A | | 4/1984 | Block et al. | |
| 4,449,329 | A | | 5/1984 | Sauerwein et al. | |
| 4,541,205 | A | | 9/1985 | Patrello | |
| 4,601,661 | A | | 7/1986 | Du Be et al. | |
| 4,760,670 | A | | 8/1988 | MacKay, Jr. | |
| 4,890,422 | A | * | 1/1990 | Reiling et al. | 451/510 |
| 4,924,634 | A | | 5/1990 | MacKay, Jr. | |
| 5,287,659 | A | | 2/1994 | Timmons et al. | |
| 5,733,183 | A | * | 3/1998 | Schierling et al. | 451/521 |
| 5,938,514 | A | * | 8/1999 | Amin et al. | 451/508 |

* cited by examiner

*Primary Examiner*—M. Rachuba
(74) *Attorney, Agent, or Firm*—Fulbright & Jaworski L.L.P.

(57) ABSTRACT

A reusable quick change mount including a support unit or backing member and a threaded retainer member or nut having a barrel which is received within a bore in the support unit. A resiliently deformable member is disposed within the bore of the support unit and frictionally engages the outer surface of the barrel on the nut to capture an abrasive device which is disposed between a flange extending outwardly from the nut and the support member. The surfaces on the support member and the flange which engage the abrasive device include anti-slip surfaces.

30 Claims, 4 Drawing Sheets

REUSABLE MOUNT FOR ABRASIVE DEVICES

CROSS-REFERENCE TO RELATED APPLICATION

The benefits of Provisional Application No. 60/138,998 filed Jun. 14, 1999 by Joseph H. MacKay for Mounting Device for Abrasive Wheels and Discs is hereby claimed.

FIELD OF THE INVENTION

This invention relates generally to abrasive articles useful for grinding, cutting and finishing and more particularly to a reusable mount for attaching such articles to a power tool adapted for rotating the article during use.

BACKGROUND OF THE INVENTION

The use of rotatably driven abrasive articles for grinding, cutting and finishing work objects is widespread and very familiar in our industrial societies. Early on, such abrasive articles were affixed to portable rotary power tools such as air motors or the like by placing an internally threaded nut through a centrally located opening in the abrasive article. The nut included a hub portion which fitted into the bore so that a head or flange portion of the nut abutted the underside of the abrasive article. The nut is adapted to be mounted to the threaded spindle of the power tool. Typically a support flange is positioned on the spindle of the power tool between the abrasive article and an annular shoulder formed on the spindle to provide backing support for the abrasive article. Typically the support is made of a metal stamping that is configured to engage the backside of the abrasive article. The direction of rotation of the spindle when the rotary motor is energized is such that the nut will self thread onto the spindle until a tight frictional engagement is provided. Typically the abrasive article when it is spent is removed from the spindle by applying a wrench to the nut. The nut in the prior art conventional assemblies is not permanently affixed to the abrasive article, but rather is intended to be reused when a worn abrasive article is replaced. Also the support flange is not permanently affixed to the abrasive article and also is intended to be reused with new disks. Typical of such prior art abrasive finishing devices and the means of attachment to the power tool are shown in U.S. U.S. Pat. Nos. 489,149; 3,596,415; 1,998,919; 566,883; 507,223; 1,162,970; 791,159; 489,149 and 3,210,892.

With these earlier prior art devices, which included the flange and nut, it was very difficult to remove the spent finishing article because of the extreme forces applied to it during operation of the power tool. As above indicated, such removal required the utilization of a wrench or other tool which expended a large amount of time and effort on the part of the user.

Subsequently it became desirable to affix the mount permanently to the abrasive device so that the entire unit may be quickly and easily attached and detached from the drive shaft of the power motor and discarded along with the abrasive article when the abrasive article has been spent. In these types of devices it has become customary to either utilize an adhesive such as an epoxy resin or the like to attach the mounting hub to the abrasive article or alternatively to crimp a portion of the mounting hub to the abrasive article to retain it permanently in place upon the abrasive article and to secure the article rotationally. Various prior art patents showing such devices are U.S. Pat. Nos. 3,136,100; 415,371; 2,278,301; 3,081,584; 3,500,592; 3,800,483; 4,240,230; 4,541,205; 3,041,797; 3,879,178; 1,724,742; 3,912,411; 3,879,178; 3,960,516; 4,026,074; 4,054,425; 4,088,729; 4,322,920; 4,439,953; 4,449,329; 4,601,661; 791,791; 872,932; 2,567,782; 3,136,100; 3,210,892; 3,621,621; 4,924,634; 5,287,659 and 4,760,670. With these devices, where a portion of the mounting structure is permanently affixed to the abrasive article an additional cost is added to the abrasive article, because of the labor in attaching the mount and the discarding of the permanently attached mounting structure.

As a result of the experience in the industry utilizing abrasive devices, it has become apparent that there is a need for a reusable mounting structure which will quickly and easily accept the abrasive article without being permanently attached in any fashion to the abrasive article and which at the same time will provide sufficient clamping to maintain the integrity of the abrasive article during operation and which will also allow the easy removal of the abrasive article from the power tool once it has been spent without the necessity of utilizing tools. That is, the user need only use his strength to grip the spent abrasive article and quickly remove it from the power tool by a simple rotational movement. That is, the abrasive article may be spun on and spun off by hand without the necessity of utilizing tools of any kind.

SUMMARY OF THE INVENTION

A reusable quick change mount for use with abrasive devices which are adapted for rotation by a rotary power tool which mount includes a nut having a barrel with a flange extending radially outward from one end thereof with the barrel adapted to be received within the central opening of the abrasive device so that at least a portion of the flange engages the abrasive device with a portion of the barrel extending beyond the abrasive device. There is also included a support unit having a centrally disposed bore having a diameter sufficiently large to receive the barrel. A resiliently deformable member extends into the bore to frictionally engage the barrel portion extending beyond the abrasive article to thereby capture the abrasive device between the flange and the support unit. Threads are provided on the barrel and are adapted to matingly engage threads carried by the rotary power tool so that during use the flange and the support unit are continuously urged toward each other to operatively clamp the abrasive device between them.

DETAILED DESCRIPTION

The reusable quick change mount constructed in accordance with the principles of the present invention provides for vary rapid and easy attachment of an abrasive device such as a grinding wheel to a power tool. The mount is automatically self-tightening during the time that the abrasive device is being used to cut, finish or otherwise operate upon metallic work pieces. After the abrasive device has been spent, the mount of the present invention is constructed in such a manner that very quick and easy removal of the spent abrasive device can be accomplished simply by rotation of the device as opposed to utilizing tools such as wrenches or the like to loosen the mount.

The reusable quick change mount of the present invention is usable upon a wide variety of abrasive devices such as grinding wheels, flap wheels, cut-off wheels and the like and may be utilized upon such devices having very small to the largest diameters. The mount employs two components neither of which is permanently installed upon the abrasive device. Each of the components is durable and reusable with large quantities of abrasive devices. As a result, the cost of mounting hubs which are permanently installed in anon-removable fashion upon abrasive devices as well as the cost of installation thereof and the waste and pollution associated with the disposal of used abrasive devices containing such permanently installed mounting hubs thereon is totally eliminated.

The two components which form the reusable quick change mount of the present invention include a support unit which functions as a backing flange for the abrasive device during use and a threaded nut or retainer member which holds the abrasive device in place for use upon the power tool. The nut includes a barrel extending from a flange with the nut being inserted into the bore centrally disposed through the abrasive device in such a manner that a portion of the barrel projects through the abrasive device. The support unit has a bore therethrough which receives that part of the barrel extending beyond the abrasive device and includes a resiliently deformable member which engages the barrel causing the abrasive device to be held between the support unit and the nut while the assembly is being handled for quick and easy attachment to a power tool.

After use, typically when the abrasive device is spent, the user merely grips the abrasive device and turns it in the counter clockwise direction to quickly and easily remove the spent abrasive device along with the nut and support unit from the power tool after which the support unit and nut are disengaged simply by pulling them apart and the abrasive device discarded. The nut and support unit are then ready for reuse by being assembled to another abrasive device.

Figure 1:
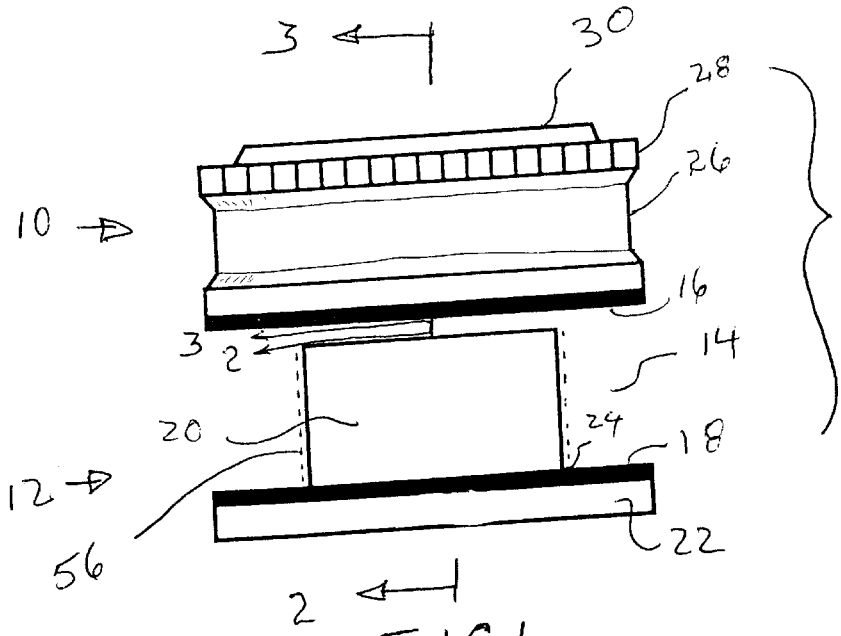
FIG. 1 is an exploded view illustrating the fundamental components of the reusable quick change mount of the present invention.
Figure 2:
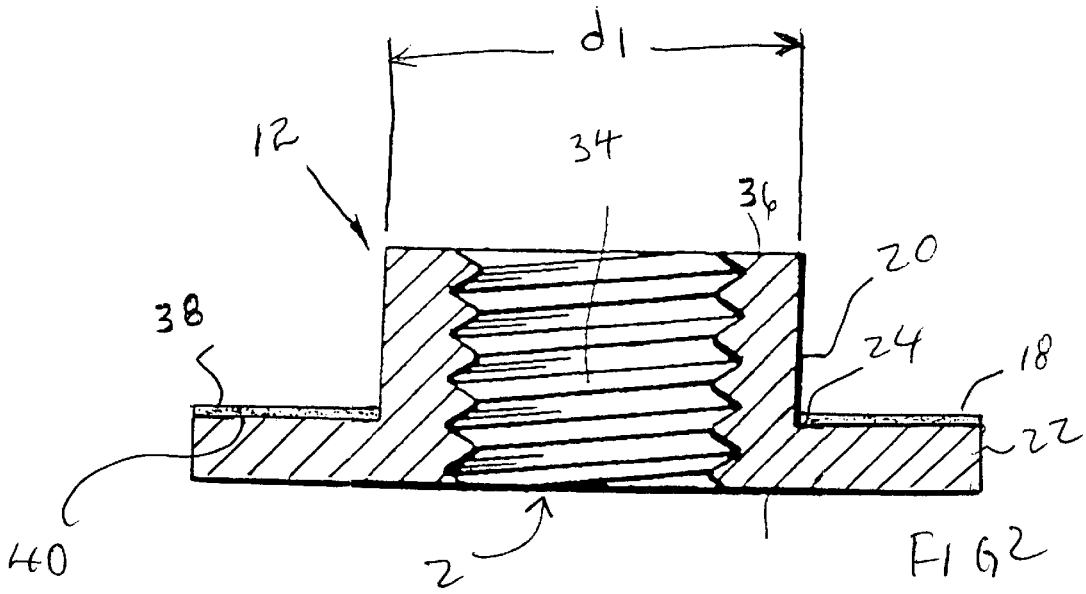
FIG. 2 is a cross-sectional view of the nut utilized as one of the components of the mount.
Figure 3:
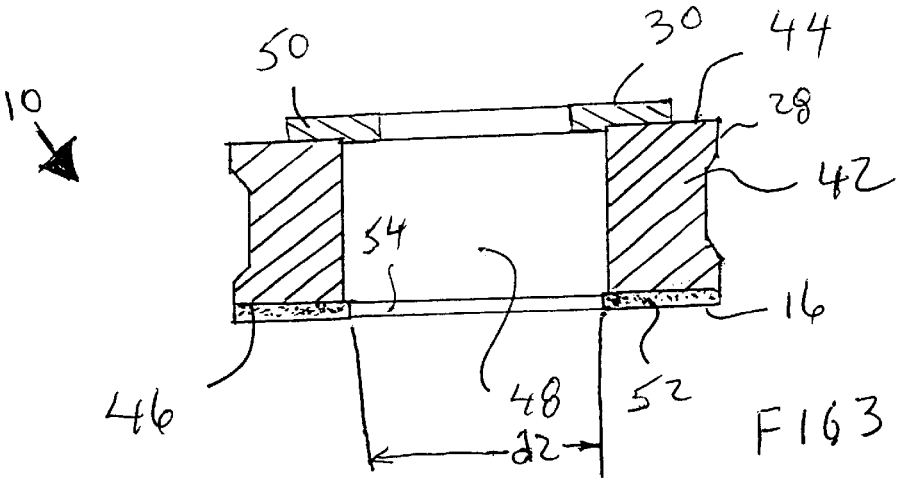
FIG. 3 is a cross-sectional view of the support unit which is the other component of the mount.

Referring now to the drawings and more particularly to FIGS. 1–3. The construction of a preferred embodiment of the reusable quick change mount of the present invention is illustrated. As is therein shown, the two components of the mount are a support unit or backing member 10 and a nut or retainer member 12. An abrasive finishing article is disposed within the space 14 between the opposed surfaces 16 and 18 of the support unit 10 and the nut 12. The surface 16 on the support unit 10 comprises an anti-slip surface as does the surface 18 on the nut 12. The nut 12 includes a barrel 20 having a flange 22 extending outwardly from a first end 24 thereof The surface 18 is the upper surface of the flange 22 and when assembled with an abrasive device will contact that device. The nut 12 is formed preferably from a unitary metallic work piece. The support unit 10 includes a reduced diameter central section 26 and an upper knurled ridge 28 which facilitates gripping and holding of the support unit 10 during installation thereof upon an abrasive member. A wear or bearing surface 30 is also provided on the support unit 10. The wear surface 30 engages a shoulder which exists upon the drive member of a power tool which is assembled with the reusable quick change mount of the present invention.

As is more clearly seen in FIG. 2, the nut 12 defines a bore 32 extending therethrough. The bore 32 is threaded as illustrated at 34. The barrel 20 has a second end 36. As is illustrated, the anti-slip surface 18 comprises a layer 38 of elastomeric material which is carried by the flange 22. The elastomeric material 38 preferably takes the shape of a washer which is adhesively secured to the upper surface 40 of the flange 22. Alternatively, the elastomeric material 38 may be a thermosetting material which is deposited upon the surface 40 and bonded thereto by curing such, for example, as by vulcanizing or the like.

The support member 10 is constructed from a metallic body 42 and includes a first surface 44 and a second surface 46. The metallic body 42 may be any material desired and preferably is machined or milled aluminum which defines a bore 48 extending therethrough. The wear surface 30 may preferably comprise a washer like member of heat treated steel 50 which is secured to the first face 44 of the body 42. The wear surface 30 provides a surface which will tolerate numerous uses of the support unit 10 with various abrasive devices. The anti-slip surface 16 on the support unit 10 preferably comprises an elastomeric material 52 which is secured to the second face 46 of the body 42. This elastomeric material preferably takes the form of a washer which is adhesively secured to the surface 46 of the body 42. Alternatively, the elastomeric material 52 may be a thermosetting elastomer which may be bonded to the face 46 by curing such, for example, as by vulcanizing or the like. The layer 52 of elastomeric material which is affixed to the surface 46 of the body 42 has an opening 54 centrally disposed therethrough. The diameter D2 of the opening is slightly smaller than the outside diameter D1 of the barrel 20 on the nut 12. As above pointed out, when the reusable quick change mount of the present invention is assembled upon an abrasive device, the barrel 20 of the nut 12 is inserted into the bore 48 of the support unit 10. Since the diameter D1 is slightly larger than the diameter D2, the elastomeric material is caused to compress slightly and to thus, engage or grip the outer surface of the barrel 20. Such gripping holds the nut and the support unit firmly together on opposite sides of the abrasive article while the combination is threaded upon the threaded shaft of the power tool through utilization of the threads 34 on the nut 12. Thus, it will be recognized that the inner edge of the elastomeric material 52 defining the opening 54 functions as a resiliently deformable member which extends into the bore 48 and frictionally engages the outside surface of the barrel 20 and effectively captures the abrasive device between the flange 22 and the support unit 10.

It should be understood by those skilled in the art that the resiliently deformable member which is adapted to extend into the bore provided in the support unit 10 may take the form of a layer of elastomeric material secured to the outer surface of the barrel 20, such for example, as illustrated by the dashed lines 56 in FIG. 1. Under such circumstances, the inner surface of the bore 48 in the support unit 10 would include an outwardly extending metallic rim or the like to frictionally engage the elastomeric material 56 to capture the abrasive device between the flange and the support unit.

Figure 4:
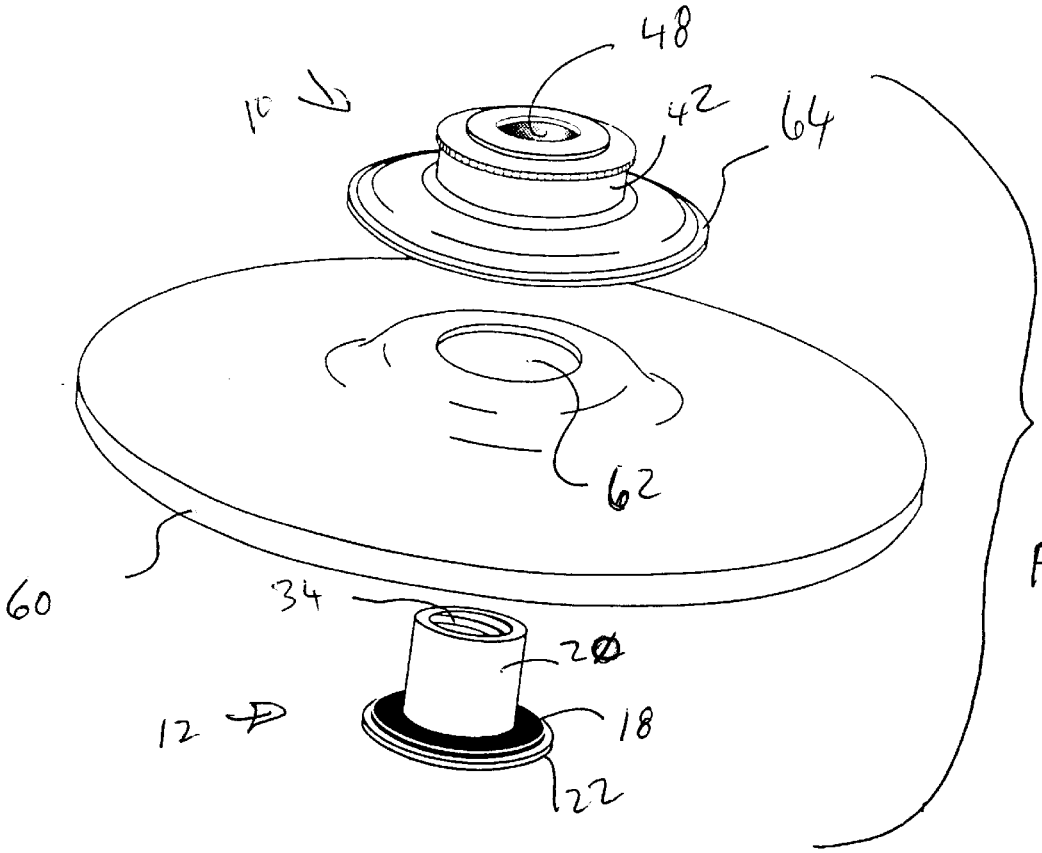
FIG. 4 is an exploded view in isometric form of the reusable quick change mount of the present invention just prior to assembly with a depressed center grinding wheel.

As above discussed, the reusable quick change mount constructed in accordance with the principles of the present invention may be utilized with various abrasives devices. Referring now more particularly to FIG. 4, there is illustrated, in exploded form, a depressed center grinding wheel 60 which is to be captured between a support unit 10 and a nut 12 constructed in accordance with the principles of the present invention. As is shown, the nut 12 includes the anti-slip surface 18 which will engage the lower surface of the grinding wheel 60. The barrel 20 of the nut 12 will be inserted through the opening 62 in the grinding wheel 60 and will be received within the bore 48 of the support unit 10. As can be clearly seen in FIG. 4, the support unit 10 may also include a backing flange 64 which is securely affixed to the body 42 of the support unit 10. When the barrel 20 of the nut 12 is inserted into the bore 48 of the support unit 10 the resiliently deformable member frictionally engages the outer surface 22 of the barrel and captures the grinding wheel 60 between the flange 22 and the support unit 10 with the anti-slip surfaces 16 and 18 engaging opposite surfaces of the grinding wheel 60. The threaded shaft of the power tool will then be inserted into the bore 48 and will be received by the threads 34 within the bore in the barrel 20.

Figure 5:
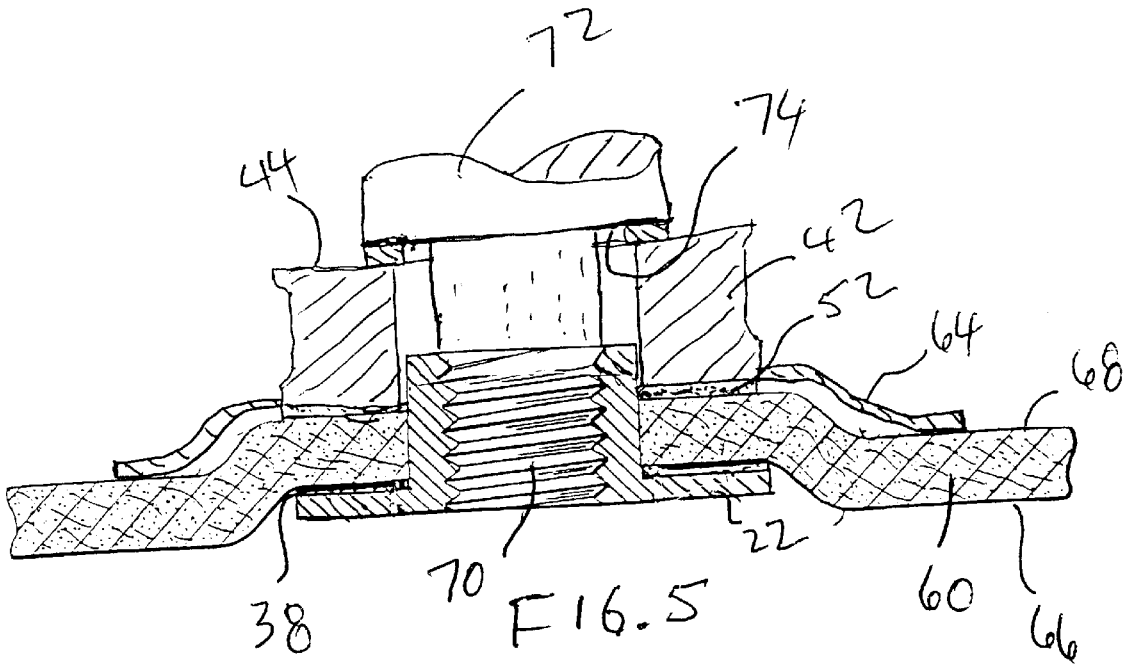
FIG. 5 is a partial cross-sectional view of the quick change mount of the present invention assembled upon a depressed center grinding wheel attached to a threaded drive member of a rotary power tool.

By reference now to FIG. 5, there is illustrated in partial cross-sectional view, the structure illustrated in FIG. 4 in assembled form ready for use. As is therein shown, the grinding wheel 60 having a first surface 66 and a second surface 68 has the barrel 20 of the nut 12 inserted through the opening 62 therein. The elastomeric washer 38 engages the first surface 66 of the grinding wheel 60. The elastomeric material 52 disposed upon the second face 46 of the body 42 engages the second surface 68 of the grinding wheel 60. The function of the resiliently deformable washer 52 frictionally engaging or gripping the outer surface of the barrel 20 is clearly shown in FIG. 5. Also illustrated is the threaded shaft 70 of a power tool 72 which is threadably engaged within the threaded bore 32 of the nut 12. A shoulder 74 formed on the power tool shaft 72 engages the wear or bearing surface disposed upon the first face 44 of the body 42 of the support unit 10. The flange 64 extends outwardly into contact with the second surface 68 of the grinding wheel 60 to provide additional support thereto. It should be clearly understood that although the backing flange 64 is shown in FIGS. 4 and 5, such is not necessarily needed for appropriate operation of the reusable quick change mount constructed in accordance with the principles of the present invention.

Those skilled in the art will now recognize that when the grinding wheel 60 is assembled as shown in FIG. 5 and is placed in use, the rotation of the grinding wheel against the work surface will cause the threads on the shaft 70 to tighten against the threads 34 on the barrel 20. This tightening continuously urges the support unit 10 and nut 12 toward each other thereby securely clamping the grinding wheel 60 to provide excellent and steady support thereof during use. When use is completed and the grinding wheel 60 is to be discarded, it may be easily removed from the threaded shaft 70 of the power tool 72 simply by gripping the remaining portion of the grinding wheel 60 and turning it in a counter clockwise direction without the use of tools of any type. The construction of the reusable quick change mount of the present invention provides immediate and easy release from the power tool 72 whereupon the nut and support unit may be separated for reuse and the spent grinding wheel 60 discarded.

Figure 6:
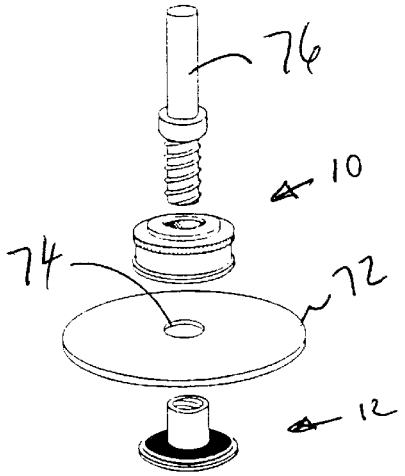
FIG. 6 is an exploded view in isometric form of the reusable quick change mount of the present invention just prior to its assembly with a cutting wheel.

By reference now to FIG. 6, there is shown in exploded view a cut-off wheel 72 to be assembled between a nut 12 and a support unit 10 in the manner above described by inserting the barrel of the nut 12 through the opening 74 in the cut-off wheel so that the resiliently deformable member within the support unit 10 frictionally engages the barrel of the nut 12 to capture the cutoff wheel 72 between the support unit 10 and the nut 12. A threaded shank 76 is then inserted through the opening in the support unit 10 to engage the threads within the barrel of the nut 12. Thereafter, the shank 76 is inserted into the chuck or the collet of a power tool for operation of the cut-off wheel 72 with the function and results as above described with regard to the grinding wheel 60.

Figure 7:
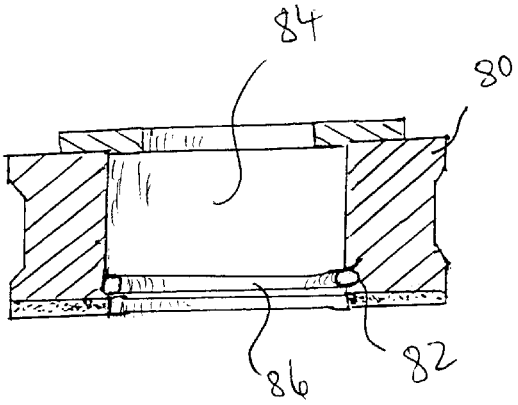
FIG. 7 is a cross-sectional view of an alternative embodiment of the support unit of the present invention.

By reference now to FIG. 7, there is illustrated an alternative embodiment of a support unit constructed in accordance with the principles of the present invention. As is therein illustrated, the body 80 of the support unit defines a groove 82 internally of the bore 84 defined therein. An O-ring 86 is seated within the groove 82 and extends into the bore 84. The inner diameter of the O-ring 86 is slightly less than the outer diameter of the barrel 20 on the nut 12. Thus, the O-ring 86 functions to frictionally engage the outer surface of the barrel 20 when the nut is inserted through an opening in an abrasive device and then into the bore 84 thereby to grip or capture the abrasive device between the nut and the support unit.

Figure 8:
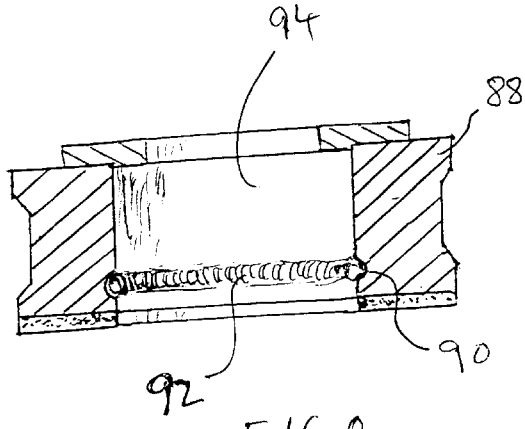
FIG. 8 is a cross-sectional view of another alternative embodiment of a support unit of the present invention.

A further alternative embodiment of the support unit constructed in accordance with the present invention is shown in FIG. 8. As is therein shown the body 88 of the support unit defines a groove 90 within which there is disposed a circular spring 92. The inner diameter of the circular spring 92 is less than the outer diameter of the barrel 20 and thus, functions as a resiliently deformable member to frictionally engage the outer surface of the barrel 20 when it is inserted into the bore 94 of the support unit as shown in FIG. 8.

Figure 9:
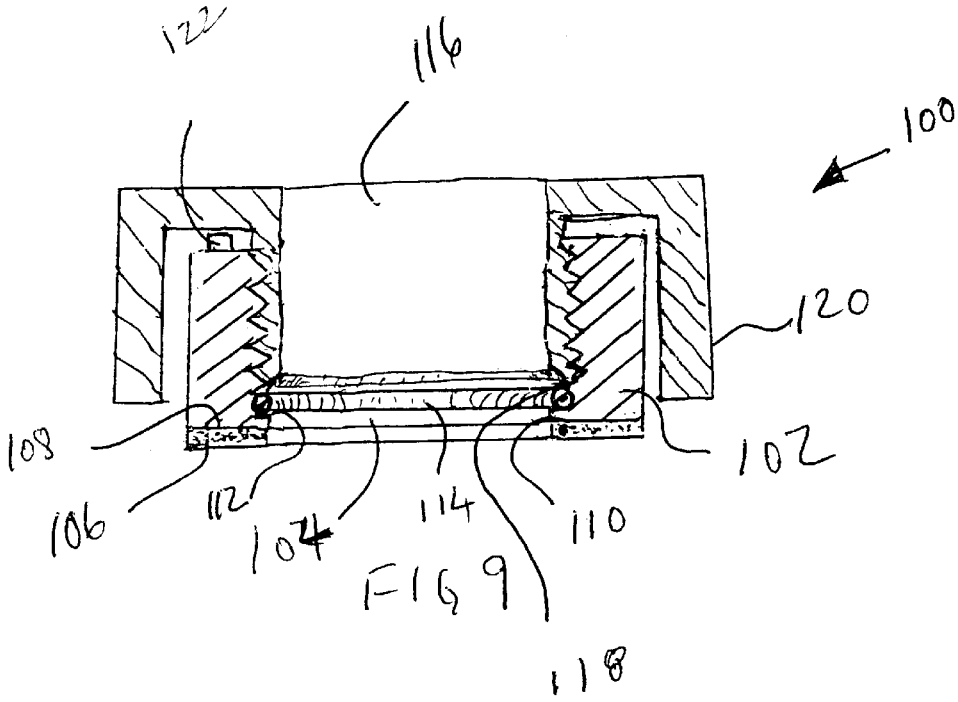
FIG. 9 is a cross-sectional view of yet another alternative embodiment of a support unit of the present invention.

Referring now more particularly to FIG. 9, there is illustrated yet an additional alternative embodiment of a support unit constructed in accordance with the principles of the present invention. As is illustrated in FIG. 9, the support unit 100 includes a body 102 defining a bore 104 therethrough. An elastomeric washer 106 is adhesively secured to a second face 108 of the body 102. As is illustrated, the bore 104 terminates in an inwardly directed flange 110 which defines a shoulder 112. An O-ring 114 is seated upon the shoulder 112. The inner diameter of the O-ring 114 is greater than the outer diameter D1 of the barrel 20 of the nut. As a result, when the barrel 20 of the nut is inserted into the bore 104 the O-ring 114 will not initially frictionally engage the outer surface thereof to provide the frictioned engagement. There is provided a threaded member 116 which is threadably received within the bore 104. The terminus of the member 116 defines a chisel like edge 118 which engages the top of the O-ring 114. As the member is rotated further, the edge 118 engages the O-ring 114 and compresses it causing the inner surface thereof to move into the bore 104 and into frictional engagement with the outer surface of the barrel 20. The member 116 is provided with a downwardly depending skirt 120 which may be gripped by the user and easily turned to cause the compression of the O-ring 114 as above described. A stop 120 may be provided in the body 102 of the support unit 100 to engage an additional arm (not shown) disposed within the member 116 to limit the rotational movement of the member 116 in a direction away from that which provides compression to the O-ring 114 to thereby prevent disassembly of the support unit 100.

Figure 10:
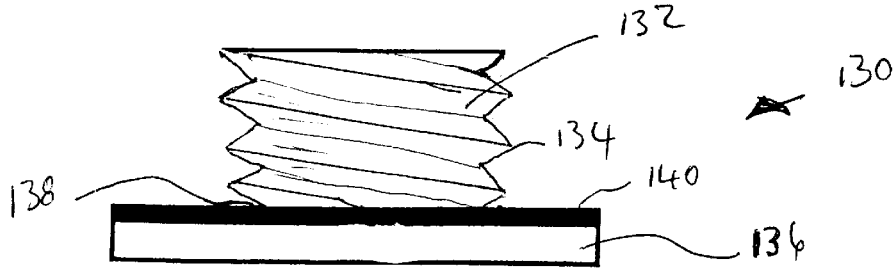
FIG. 10 is an elevational view of a nut adapted for use with a power tool having a female threaded spindle.

Some power tools utilize a driving shaft which defines a bore having threads therein. To utilize the reusable quick change mount of the present invention with such a drive member on a power tool the nut or retainer member of the present invention must be modified. By reference now to FIG. 10, such a modification is illustrated. As is shown therein, the nut or retainer member 130 includes a barrel 132 which defines threads 134 on the outer surface thereof. An outwardly extending flange 136 extends from a first end 138 of the barrel 132. An anti-slip surface 140 is provided upon that surface of the flange 136 which will engage the abrasive finishing device in the manner above described. The nut 130 as shown in FIG. 10 functions in precisely the same manner as that as above described. By having the threads externally disposed on the barrel 132 the internally threaded bore on the power tool may make engagement with such threads to attach the mount along with the abrasive device to the power tool.

There has thus been disclosed a reusable a reusable quick change mount for use with abrasive devices which may be quickly and easily assembled on the abrasive device and easily and quickly removed when the device is to be discarded after use, after which, the mount may be reused with yet an additional or different abrasive device.

What is claimed is:

1. A reusable quick change mount for use with abrasive devices having first and second surfaces and having a central opening there through and adapted for rotation by a rotary power tool carrying threads, said mount comprising:

(a) a nut having a barrel carrying threads formatting with the threads carried by said power tool and having an outer diameter, said barrel having first and second ends;

(b) a flange extending radially outward at said first end of said barrel;

(c) said barrel being adapted to be received in said central opening of said abrasive device with a portion of said flange engaging said first surface thereof and a portion of said barrel including said second end extending beyond said second surface thereof;

(d) a support unit having a body defining a first bore centrally disposed therethrough, said first bore having a diameter sufficiently large to receive said barrel;

(e) a resiliently deformable member adapted to extend into said first bore and frictionally engage said barrel portion extending beyond said second surface thereby to capture said abrasive device between said flange and said support unit; and (f) said threads, when engaged, and when said abrasive device is being used function to operatively clamp said abrasive device between said flange and said support unit by continuously urging said flange and said support unit toward each other.

2. A reusable quick change mount as defined in claim 1 wherein said resiliently deformable member is carried by said support unit.

3. A reusable quick change mount as defined in claim 1 wherein said resiliently deformable member is carried by said barrel.

4. A reusable quick change mount as defined in claim 2 wherein the portion of said flange engaging said first surface of said abrasive device includes an anti-slip surface.

5. A reusable quick change mount as defined in claim 4 wherein said anti-slip surface is formed by an elastomeric material carried by said flange.

6. A reusable quick change mount as defined in claim 5 wherein said elastomeric material is a washer shaped material adhesively secured to said flange.

7. A reusable quick change mount as defined in claim 5 wherein said elastomeric material is a thermosetting elastomer deposited on and bonded to said flange.

8. A reusable quick change mount as defined in claim 1 wherein said support unit body includes first and second faces, said first face being disposed away from said second surface of said abrasive device when assembled thereon, said first face further including a wear surface surrounding said first bore.

9. A reusable quick change mount as defined in claim 8 wherein said wear surface on said first face is a heat treated steel material.

10. A reusable quick change mount as defined in claim 8 wherein said wear surface is a hard plastic material.

11. A reusable quick change mount as defined in claim 8 wherein said wear surface is a washer shaped material secured to said support unit.

12. A reusable quick change mount as defined in claim 1 wherein said support unit body includes a first face and a second face, said second face being directed toward said second surface of said abrasive device when assembled therewith, said second face including an anti-slip surface.

13. A reusable quick change mount as defined in claim 12 wherein said anti-slip surface on said second face is an elastomeric material secured to said second face.

14. A reusable quick change mount as defined in claim 12 wherein said elastomeric material is a washer shaped material adhesively secured to said second face.

15. A reusable quick change mount as defined in claim 12 wherein said anti-slip surface is a thermosetting elastomer deposited upon said second face.

16. A reusable quick change mount as defined in claim 13 wherein said elastomeric material extends inwardly into said second bore to form said resiliently deformable member for frictionally engaging said barrel portion.

17. A reusable quick change mount as defined in claim 1 wherein said resiliently deformable member is an O-ring having an inner diameter.

18. A reusable quick change mount as defined in claim 17 wherein said inner diameter of said O-ring is smaller than said outer diameter of said portion of said barrel extending beyond said second surface.

19. A reusable quick change mount as defined in claim 17 wherein said inner diameter of said O-ring is larger than said outer diameter of said barrel portion extending beyond said second surface and said support unit further includes a member for engaging said O-ring and upon such engagement, compressing said O-ring into engagement with said barrel portion extending beyond said surface of said abrasive device.

20. A reusable quick change mount as defined in claim 1 wherein said resiliently deformable member is a spring.

21. A reusable quick change mount as defined in claim 19 wherein said support unit body includes a first face and a second face, said second face being directed toward said second surface of said abrasive device when assembled therewith, said first bore having an inwardly extending flange defining a shoulder disposed adjacent said second face, said O-ring being carried by said shoulder, said O-ring being compressed between said member and said shoulder.

22. A reusable quick change mount as defined in claim 21 wherein said member is threadably received within said first bore and is rotatable between a first position wherein said O-ring is not compressed and a second position wherein said O-ring is compressed into engagement with said portion of said barrel.

23. A reusable quick change mount as defined in claim 22 wherein said support body further includes a stop for preventing rotation of said member from said second position past said first position.

24. A reusable quick change mount as defined in claim 1 wherein said nut defines a second bore centrally disposed there through, said second bore carrying said threads disposed on said barrel.

25. A reusable quick change mount as defined in claim 1 wherein said nut and flange are formed from a unitary member and said barrel defines an external surface carrying said threads disposed on said barrel.

26. A reusable quick change mount for use with abrasive devices having first and second surfaces and having a central opening there through and adapted for rotation by a rotary power tool carrying threads, said mount comprising:

(a) a nut having a barrel having an outer diameter, and defining a first threaded bore centrally disposed there through, said barrel having first and second ends, said threads and said first bore mating with the threads carried by said power tool when said abrasive device with said quick change mount assembled thereon is mounted upon said power tool;

(b) a flange extending radially outward at said first end of said barrel;

(c) said barrel being adapted to be received in said central opening of said abrasive device with a portion of said flange engaging said first surface thereof and a portion of said barrel including said second end extending beyond said second surface thereof;

(d) a support unit having a body having first and second faces and said body defining a first bore centrally disposed there through, said first bore having a diameter sufficiently large to receive said barrel;

(e) an inwardly directed shoulder disposed within said second bore adjacent said second face;

(f) an O-ring disposed upon said shoulder and adapted to extend into said second bore and frictionally engage said barrel portion extending beyond said second surface thereby to capture said abrasive device between said flange and said support unit; and (g) said threads, when engaged, and when said abrasive device is being used function to operatively clamp said abrasive device between said flange and said second face of said support unit by continuously urging said flange and said support unit toward each other.

27. A reusable quick change mount as defined in claim 26 wherein said portion of said flange engaging said first surface of said abrasive device includes an elastomeric material secured thereto to provide an anti-slip surface thereon.

28. A reusable quick change mount as defined in claim 27 wherein said second face of said support unit body includes an elastomeric material secured thereto to provide an anti-slip surface for engaging said second surface of said abrasive device when assembled therewith.

29. A reusable quick change mount as defined in claim 28 wherein said second bore defines a plurality of threads and wherein, said support unit further includes a member threadably engaging said threads in said first bore for engaging said O-ring and upon such engagement, compressing said O-ring into engagement with said barrel portion extending beyond said surface of said abrasive device.

30. A reusable quick change mount as defined in claim 29 wherein said threaded member further includes a downwardly extending skirt which surrounds said body of said support unit and extends downwardly from said first face towards said second face.

* * * * *